United States Patent [19]

Grimm et al.

[11] 4,402,177

[45] Sep. 6, 1983

[54] PROCESS AND APPARATUS FOR STOPPING AN OPEN-END SPINNING APPARATUS

[75] Inventors: Eberhard Grimm; Rudolf Oexler, both of Ingolstadt; Eugen Hini, Lenting, all of Fed. Rep. of Germany

[73] Assignee: Schubert & Salzer, Ingolstadt, Fed. Rep. of Germany

[21] Appl. No.: 331,203

[22] Filed: Dec. 16, 1981

[30] Foreign Application Priority Data

Dec. 24, 1980 [DE] Fed. Rep. of Germany ..... 3049139

[51] Int. Cl.[3] ..... D01H 1/241

[52] U.S. Cl. ..... 57/88; 57/89; 57/104

[58] Field of Search ..... 57/78, 88, 89, 104, 57/105

[56] References Cited

U.S. PATENT DOCUMENTS

| | | | |
|---|---|---|---|
| 3,805,506 | 4/1974 | Stahlecker | 57/88 X |
| 3,868,815 | 3/1975 | Stahlecker | 57/88 |
| 3,878,672 | 4/1975 | Kohler | 57/104 X |
| 4,103,479 | 8/1978 | Stahlecker et al. | 57/88 X |

FOREIGN PATENT DOCUMENTS 1540440 2/1979 United Kingdom .

*Primary Examiner*—Donald Watkins

*Attorney, Agent, or Firm*—Julian W. Dority

[57] ABSTRACT

An apparatus and method for stopping operation of an open-end spinning machine is disclosed whereby the rotor shaft 1 of the spinning rotor and the shafts 30, 40 of the support rollers 3, 4 are rapidly but gently stopped by applying a braking force to the shafts of the support rollers after the rotor shaft is braked. Preferably a single force is shared and applied in timed sequence for braking the rotor shaft and the support roller shafts. The apparatus for carrying out the method includes a pivotable lever 7 which is pivotable about an axis 70 and carries a support 73 having a brake lining which receives the rotor shaft 1. A belt lifting roller 72 is carried on the pivotable lever which lifts a tangential belt 5 off of the rotor shaft 1 to thus stop the drive of the spinning rotor. The support 73 is elastically carried on the lever 7 by means of a U-shaped spring 74. A pair of brake jaws 80, 81 are carried on a common mounting piece 8 about a fulcrum 80 which can be pressed against the shafts 30, 40 of the support rollers 3, 4 after the shaft 1 has been pressed onto a stop 6 by means of engagement with the support and brake 73. Good guiding of the support 73 and uniform seating of its brake lining on the shaft 1 is achieved by the U-shaped configuration of spring 74. The common mounting 8 of the brake jaws moves in a pendulum fashion on the lever 7 whereby the brake jaws are self-centering and exert a uniform pressure on the shafts of the support rollers.

7 Claims, 1 Drawing Figure

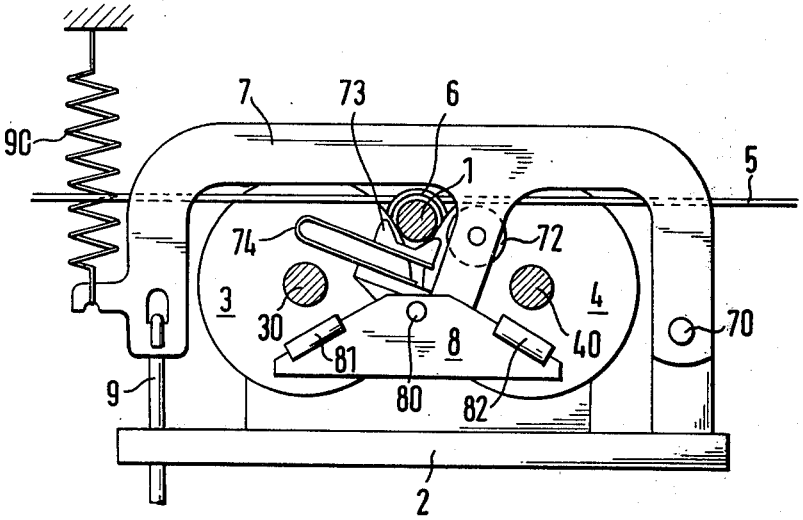
7
73
6
90
1
5
74
72
3
30
4
40
70
81
8
80
82
9
2

PROCESS AND APPARATUS FOR STOPPING AN OPEN-END SPINNING APPARATUS

BACKGROUND OF THE INVENTION

The present invention relates to a method and apparatus for stopping an open-end spinning machine in which the shaft of the spinning rotor is braked. During operation, the shaft is mounted in a wedge-shaped gap formed by freely rotatable support rollers and the shaft is pressed against the support rollers and driven by a tangential belt. The rotor shaft is moved away from the support rollers after the tangential belt is lifted off of the shaft and is pressed and braked against stops constructed as a support mounting on the machine.

It is known from DE-AS No. 2,525,435 to effect stopping of the rotor of an open-end spinning apparatus by first lifting from the shaft the tangential belt which in operation presses the rotor shaft into the wedge-shaped gap formed by freely rotatable support rollers. The shaft is then moved away from the support rollers and pressed against stops constructed as support mountings on the machine by which it is braked. The known apparatus provides a lever pivotable about an axis which carries a support receiving the shaft having a brake lining and a belt lifter roller. A gentle and rapid stopping of the rotor is possible in the predetermined sequence of separating the tangential belt and the braking of the shaft. However, upon restarting the apparatus after only a short interruption, such as in piecing a yarn break, the rotor shaft is set on the support rollers still rotating which suddenly brakes them. The plastic coverings of the support rollers and the shaft are thus subjected to strong, non-uniform wear. This can adversely affect the true running of the rotor and thus the spinning quality if these parts are not changed in time at an entailed cost.

Accordingly, an important object of the present invention is to reduce and eliminate this wear between the support rollers and rotor shaft thereon such as occurs upon start-up following a short stop in operation.

SUMMARY OF THE INVENTION

This object is achieved according to the present invention by applying a braking force to the shafts of the support rollers after the rotor shaft is moved away from the support rollers.

The rotor shaft and also the support rollers are thus rapidly but gently stopped, so that a gentle starting of the apparatus is possible even after a short stoppage time.

Substantially simultaneous stoppage of the support rollers and of the rotor shaft, which is rotating substantially faster, is achieved by applying the braking force to the support rollers after application of the braking force to the shaft. Preferably, a single force is shared and applied successively for braking the rotor shaft and the support roller shafts.

The apparatus for carrying out the method includes a lever which is pivotable about an axis and which has a support with a brake lining which receives the rotor shaft, and a belt lifter roller. The support is elastically arranged on the lever and the lever carries brake jaws which can be pressed against the shafts of the support rollers after the shaft has been moved away from the support rollers. The support is elastically attached to the pivotable lever by a spring having a force which must be overcome to press the brake jaws against the shafts of the supporting rollers. Good guiding of the support and uniform seating of its brake lining on the shaft is achieved by making the spring U-shaped. The brake jaws are appropriately attached to a common mounting which moves in pendulum fashion on the lever whereby the brake jaws are self-centering and exert a uniform pressure on the shafts of the support rollers.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 1 is a schematic cross-section illustrating a spinning rotor mounting and apparatus for stopping the rotor shaft and shafts of the support rollers according to the invention.

DESCRIPTION OF A PREFERRED EMBODIMENT

A horizontally arranged shaft 1 of an open-end spinning rotor (not shown) is mounted conventionally in operation in a wedge-shaped gap formed by two spaced-apart support roller pairs, and is secured in an axial direction by a (not visible) axial bearing. The rear pair of support rollers 3, 4 adjacent the axial bearing, include associated shafts 30, 40 which are attached to rotate with the rollers and which are mounted rotatably on a mounting plate 2, as can be seen in the drawing. Mounting plate 2 may, in turn, be mounted to a frame of the associated spinning machine. Shaft 1 is driven by a tangential belt 5, which is pressed by a tensioning roller (not shown) against shaft 1 in operation. Shaft 1 is pressed in the radial direction into operational engagement in the wedge-shaped gap of the support roller pairs and against the rollers by the tangential belt 5. The shaft, the diameter of which is considerably greater than that of the support rollers, runs with a rotational speed which is a multiple higher than that of the support rollers, for example, with an eightfold higher speed. Stop means in the form of a stationary stop 6 and a further stop near the spinning rotor are associated with the shaft 1 and surround the shaft annularly at a predetermined spacing corresponding to the permissible lifting path of the shaft, and are constructed as support mountings.

The apparatus for stopping the spinning apparatus contains a lever 7 which is pivotably mounted on a shaft 70 affixed on the mounting plate 2. Attached to lever 7 is a belt lifter roller 72 and a support 73 receiving the shaft 1, having a brake lining. However, the support 73 is not rigidly arranged on the lever 7, but elastically by means of a spring 74. In the example of an embodiment, the spring 74 is a U-shaped bent leaf spring, one shank of which is fastened to the lever 7 and the other shank carries the support 73. Instead of a U-shaped spring, in appropriate circumstances a leaf spring with only one shank can also be utilized which is affixed on one side to the lever 7 and carries the support 73 at its free end. A compression spring may also be utilized. However, the U-shaped spring is preferred because it ensures a better guiding of the support 73 and a uniform abutment of its brake lining over its whole length on the shaft 1.

On lever 7 there is furthermore arranged a mounting 8 in the form of a balance which can move in pendular fashion about a stationary pin 8 and has a brake jaw 81 and 82 for each of the shafts 30 and 40 connected to the support rollers. Brake jaws 81 and 82 are arranged at a distance from the shafts 30 and 40 such that they make contact with the shafts 30, 40 to apply a braking force only after the shaft 1 has moved away from the support rollers 3, 4. Preferably, the braking force is applied to the shafts 30 and 40 of the support rollers after a braking force has been applied to shaft 1 by abutment of the shaft on stop 6 and the stop adjacent to the spinning rotor.

The lever 7 is held in a ready position shown in the drawing by an arrestable pull rod 9. A spring 90, the spring force of which is greater than that of spring 74, urges the lever against the pull rod in an upward direction.

For stopping, the arresting of the pull rod 9 is released, so that the lever 7 is pivoted by the tension of the spring 90 about the shaft 70 clockwise. The belt lifter roller 72 arranged between the shaft 70 and the support 73 thus first lifts the tangential belt 5 from the shaft 1. The shaft 1 is then lifted out of the wedge gap off of the support rollers by means of the support 73 and is pressed against the stop 6 and also the stop located in the neighborhood of the spinning rotor. A braking force determined by the force of the spring 90 is thus applied to the shaft, the rotational speed of which is correspondingly reduced. After the shaft moves away from the support rollers, preferably after application of the braking force to the shaft, a braking force is exerted on the shafts 30, 40 of the support rollers, in that the pivoting motion of the lever 7 effected by the spring 90 is continued. This results from the force of the spring 74 being overcome. The brake jaws 81 and 82 are the pressed against the shafts 30 and 40 and exert their braking action until the shafts, and hence the support rollers, have stopped, while the braking pressure of the support 73 on the shaft 1 continues. The pendulum mounting of the mounting 8 about fulcrum 80 has the effect that the brake jaws center themselves and pess uniformly on both shafts 30 and 40 at the same time. The braking force exerted on the shafts and on shaft 1 has a defined magnitude, since the force of the spring 90 is used as the single force for stopping them, and this force is shared in succession for braking the shaft and the support rollers.

Thus, the invention facilitates in a simple way a rapid but gentle stopping of the shaft and the support rollers. After a yarn break, or other circumstances which require only a short stoppage of the apparatus, the stationary rotor shaft 1 is placed in the wedge-shaped gap of the likewise stationary support rollers whereby a practically wear-free change from the inoperative to the operating position results.

While a preferred embodiment of the invention has been described using specific terms, such description is for illustrative purposes only, and it is to be understood that changes and variations may be made without departing from the spirit or scope of the following claims.

What is claimed is:

1. A method for stopping an open end spinning apparatus of the type which includes a spinning rotor, a shaft mounted to said rotor, a plurality of rotatable support rollers having axial shafts, said support rollers defining a wedge-shaped gap therebetween in which said shaft is supported for rotation during operation, a tangential belt engaging said shaft which presses said shaft against said support rollers and by which said shaft is driven, means for lifting said tangential belt off of said shaft, means for moving said shaft away from said support rollers after said tangential belt is lifted off of said shaft, stop means against which said shaft is braked when said tangential belt is lifted off of said shaft, wherein the method comprises applying a braking force to said shafts of said support rollers after said rotor shaft is moved away from the support rollers.

2. The method according to claim 1 wherein said braking force supplied to said support roller shafts is applied after said rotor shaft is braked.

3. The method according to claims 1 or 2 including applying a single braking force which is applied in succession to said rotor shaft and said support rollers for braking said rotor shaft and support rollers in respective timed sequence.

4. Apparatus for stopping an open end spinning machine of the type which includes a spinning rotor having a shaft, a plurality of rotatable support rollers affixed on axial shafts, said support rollers defining a wedge-shaped gap therebetween in which said rotor shaft is supported during operation, a tangential belt tangentially engaging said rotor shaft pressing said shaft against said support rollers by which said roller shaft is driven, means for lifting said tangential belt off of said rotor shaft, means for moving said shaft away from said support rollers after said tangential belt is lifted off of said rotor shaft, and stop means against which said rotor shaft is pressed and braked when said rotor shaft is moved away from said support rollers, wherein said apparatus comprises:

a pivotable lever;

a support carried on said lever for receiving said rotor shaft, said support having a brake lining;

said support being eleastically carried on said pivotable lever; and a pair of brake jaws carried by said lever engaging said shafts of said support rollers after said rotor shaft has been moved away from said support rollers.

5. Apparatus according to claim 4 wherein said support is elastically carried by means of a U-shaped spring having one leg carried by said pivotable lever and an opposing leg on which said support is carried.

6. Apparatus according to claim 4 or 5 wherein said brake jaws are fastened to a common mounting member carried by said pivotable lever.

7. Apparatus according to claim 6 wherein said mounting member is arranged on said pivotable lever for movement in a pendulum motion about a fulcrum.

* * * * *